US012629607B2

(12) United States Patent
Brugniaux

(10) Patent No.: US 12,629,607 B2
(45) Date of Patent: May 19, 2026

(54) PROJECTILE PART FORMING A SMALL TOY TO BE THROWN BY HAND

(71) Applicant: Maxime Brugniaux, Les Lilas (FR)

(72) Inventor: Maxime Brugniaux, Les Lilas (FR)

( * ) Notice: Subject to any disclaimer, the term of this patent is extended or adjusted under 35 U.S.C. 154(b) by 147 days.

(21) Appl. No.: 18/687,540

(22) PCT Filed: Aug. 31, 2022

(86) PCT No.: PCT/FR2022/051634
§ 371 (c)(1),
(2) Date: Feb. 28, 2024

(87) PCT Pub. No.: WO2023/031554
PCT Pub. Date: Mar. 9, 2023

(65) Prior Publication Data

US 2024/0390814 A1 Nov. 28, 2024

(30) Foreign Application Priority Data

Sep. 1, 2021 (FR) ..... 2109125

(51) Int. Cl.
*A63H 33/18* (2006.01)

(52) U.S. Cl.
CPC ..... *A63H 33/18* (2013.01)

(58) Field of Classification Search
CPC ..... A63H 33/18; A63B 67/06
USPC ..... 446/46, 48, 486; 473/588, 589, 592; 124/79
See application file for complete search history.

(56) References Cited

U.S. PATENT DOCUMENTS 1,683,643 A * 9/1928 Wittmaak ..... A63B 65/10 473/589
3,959,915 A * 6/1976 Kettlestrings ..... A63H 27/14 473/588
4,152,863 A * 5/1979 Kubiatowicz ..... A63H 37/005 446/486

(Continued)

FOREIGN PATENT DOCUMENTS

CN 2737445 Y * 11/2005
FR 2792537 A1 * 10/2000 ..... A63H 33/18

(Continued)

OTHER PUBLICATIONS

ISA European Patent Office, International Search Report Issued in Application No. PCT/FR2022/051634, Nov. 7, 2022, WIPO, 5 pages.

*Primary Examiner* — Alexander R Niconovich
(74) *Attorney, Agent, or Firm* — Alleman Hall LLP

(57) ABSTRACT

Projectile part intended to be thrown by a user's fingers, the projectile part being in the form of a small plate with an outer contour, in which part there are provided a proximal bearing zone intended to receive the pad of a proximal phalanx of the index finger, a distal bearing zone intended to bear on the distal phalanx of the index finger, the proximal bearing zone comprising at least one rear proximal protuberance, the projectile part comprising a through-orifice arranged at a distance from the proximal bearing zone, said orifice having an orifice contour with a front portion forming an intermediate bearing zone, and intended to receive a propulsion force produced by the nail of the thumb, and a rear portion intended to receive the tip of the thumb. Method for throwing such a part.

19 Claims, 13 Drawing Sheets

(56) References Cited

U.S. PATENT DOCUMENTS 4,261,135 A * 4/1981 Lehman ..... A63H 33/18 473/588
4,265,454 A * 5/1981 Bayless ..... A63B 67/06 473/591
4,354,326 A * 10/1982 Mathews ..... A63H 33/18 473/592
4,453,338 A * 6/1984 Lehman ..... A63H 33/18 473/588
5,516,114 A * 5/1996 Michlin ..... A63F 9/0278 473/588
5,800,236 A * 9/1998 Joun ..... G02B 23/00 446/46
5,845,908 A * 12/1998 Reichardt ..... A63F 7/40 273/317
6,383,052 B1 * 5/2002 McCarthy ..... A63H 33/18 446/153
6,416,378 B2 * 7/2002 Yurkoski ..... A63H 33/18 446/61
7,654,880 B2 * 2/2010 Schneider ..... A63H 33/18 446/62
8,246,497 B1 * 8/2012 Garcia ..... A63B 65/00 473/589
10,238,986 B2 * 3/2019 Peru ..... A63H 33/18
11,738,257 B2 * 8/2023 Platt ..... A63H 33/18 124/79
2001/0024923 A1 * 9/2001 Streit ..... A63H 33/18 446/36
2003/0134561 A1 * 7/2003 Fontaign ..... A63H 33/18 446/46
2012/0058703 A1 * 3/2012 Mandeville, V ..... A63H 33/18 446/46
2012/0225739 A1 * 9/2012 Cheshire ..... A63B 65/10 273/378
2024/0165474 A1 * 5/2024 Bazzoni ..... A63B 67/06

FOREIGN PATENT DOCUMENTS

JP S6185293 U * 6/1986
JP 2003079970 A * 3/2003
TW I245657 B * 12/2005
WO 2005097284 A1 10/2005

* cited by examiner

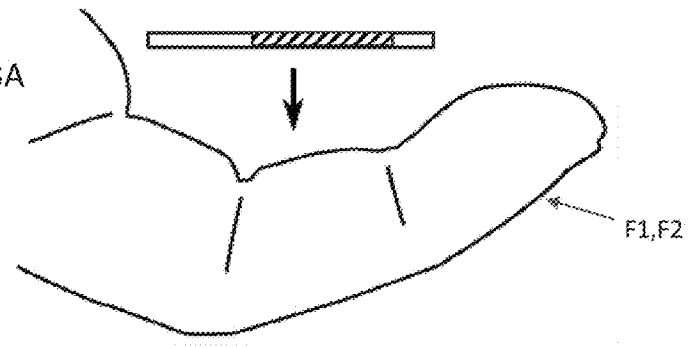
FIG. 13A
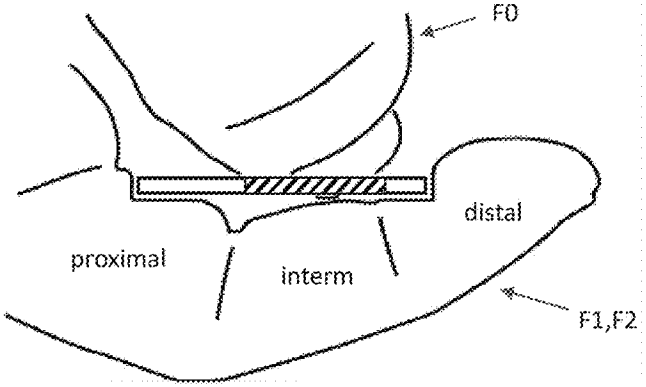
FIG. 13
FIG. 13B
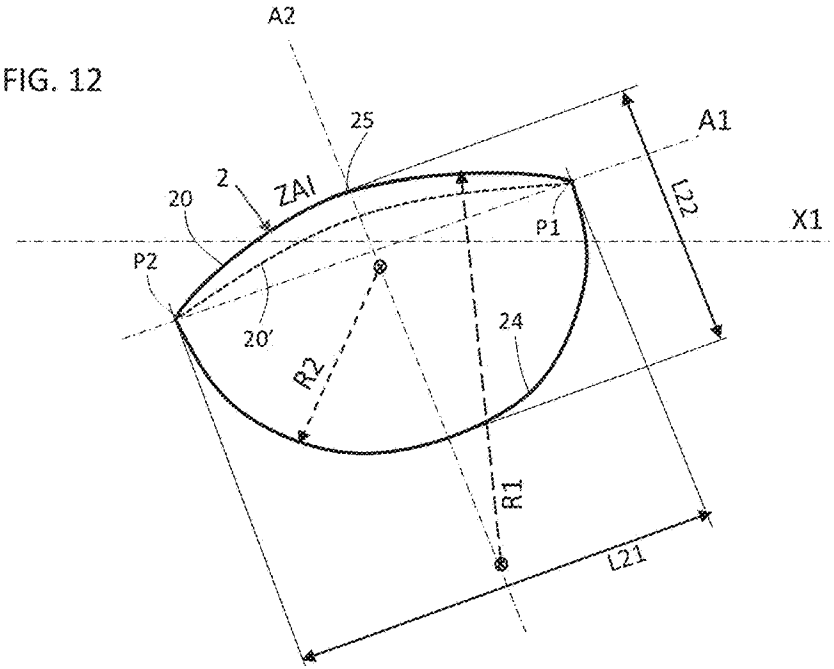
FIG. 12

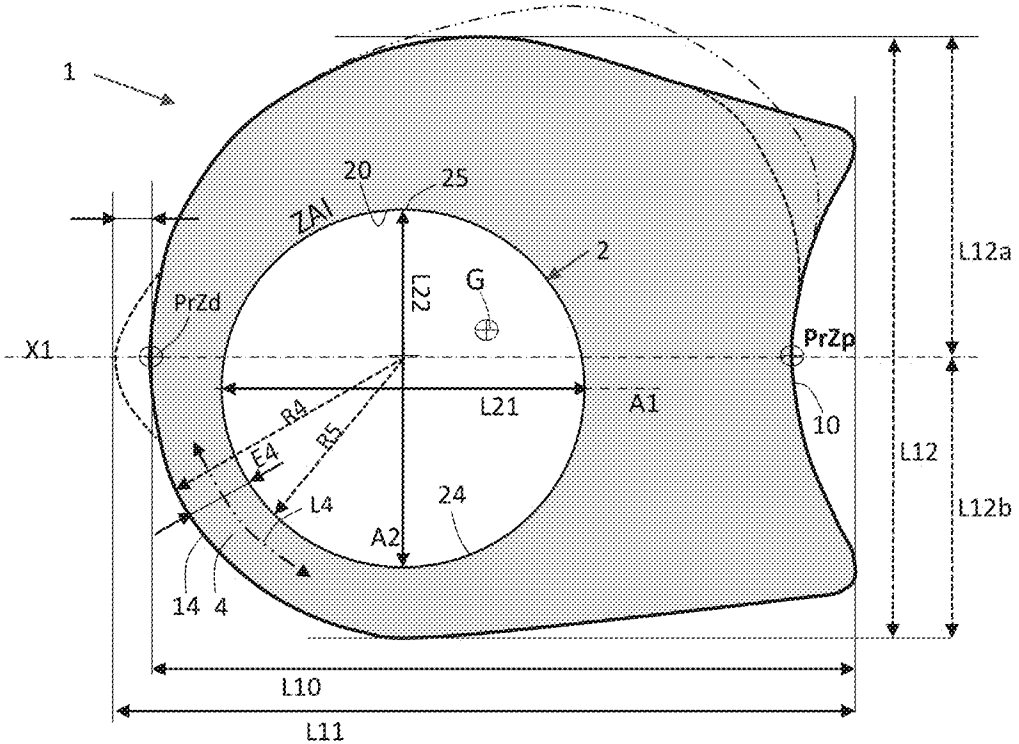
FIG. 14
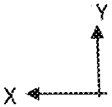

PROJECTILE PART FORMING A SMALL TOY TO BE THROWN BY HAND

The present invention relates generally to parts forming small toys to be thrown by hand. Here we are interested in projectile parts to be thrown by the fingers of a user of said toy.

TECHNICAL FIELD

Small toys to be thrown of the type considered are known from the documents FR2792537, US2012058703 or WO2005097284.

A need has arisen to propose another solution with a different throwing experience.

SUMMARY

For this purpose, a projectile part is therefore proposed intended to be projected by means of the thumb and a digital support (mobilizing the index and/or middle finger, without excluding the ring finger) of a user's hand, said projectile part presenting itself as a small plate having a thickness of between 0.3 mm and 5 mm and preferably of between 1 mm and 2 mm, said projectile part being delimited by an outer contour, the latter comprising a front edge on the side of the projection direction and a rear edge on the opposite side, a proximal edge and a distal edge, characterized in that a proximal bearing zone (ZAP) is provided intended to receive at least one phalanx of the digital support, a distal bearing zone (ZAD) intended to bear on at least one other phalanx of the digital support, the proximal bearing zone (ZAP) comprising at least one rear proximal protrusion, and in that said projectile part comprises a through orifice (2) arranged away from the proximal edge, said orifice having an orifice contour with a front portion (20) forming an intermediate bearing zone (ZAI) intended to receive a propulsion force formed by a bearing of the thumbnail, and a rear portion (24) intended to receive the tip of the thumb, and in that a longitudinal axis (X1) is defined extending between a proximal reference point (PrZp) of the proximal bearing zone (ZAP) and a distal reference point (PrZd) of the distal bearing zone, the projectile part having a reference length noted Lzz taken along said longitudinal axis, and the through orifice having, along the longitudinal axis (X1), an overall dimension noted Lox, thanks to which a first dimensional ratio RD1=Lox/Lzz is defined, which first dimensional ratio RD1 is greater than 25%, and in that the through orifice has an orifice width (L21) along a transversal orifice direction, said first orifice axis (A1), the through orifice being separated from the distal edge by an escapement strip (4), the escapement strip having a minimum width (E4) which is less than the orifice width (L21), and in that said projectile part is such that the mass of the projectile is less than 7 grams, and the reference length Lzz is less than 49 mm, such that the user may, according to an example of throwing, place the projectile part on his index finger and/or his middle finger with the tip of his thumb inserted into the orifice, then by pushing the thumb forward, exert a tension curving thanks to the proximal bearing zone and the distal bearing zone, and beyond a predetermined tension threshold, the distal bearing zone is released and the projectile part is then projected forward with a concurrent rotational movement, the rotational movement being imparted by the retention effect on the side of the proximal bearing zone.

Thanks to these arrangements, the projection of the projectile part forwards, accompanied by a simultaneous rotational movement of axis perpendicular to a general small plate plane, usually substantially vertical for a flat throw (at least at the beginning of the travel) makes it possible to obtain a particularly advantageous radius of action. The rotational movement and the associated gyroscopic effect make it possible to obtain a stable and fairly linear trajectory (at least at the beginning of the travel). After a few throws, accurate and repeatable shots may be made.

It may be remarked that in the bearing zones, portions are encompassed that are located on the sections of the projectile part; but for the proximal and distal bearing zones, the bearing zones also encompass lower surfaces as well as the rims connecting the lower surfaces to the section. As the intermediate bearing zone, it also encompasses the upper surface as well as the rims connecting the upper surface to the section.

The projectile part is sufficiently light to be propelled several meters by the power of the thumb alone.

The projectile part is sufficiently small to be interposed between two phalanxes of a same finger, i.e. straddling two phalanxes.

The size and shape of the through orifice are particularly suited to accommodate the insertion of the tip of the thumb with the nail bearing on the front portion.

Note that the rear portion of the orifice intended to receive the tip of the thumb forms a stop for the flesh portion of the end of the thumb.

In the present document, the term "digital support" designates one or more internal zones of the fingers, i.e. either the index finger or the middle finger or both without excluding the ring finger. In practice, the "digital support" comprises zones of the palmar face of one or more of the aforementioned fingers.

In the present document, the term "small plate" should be understood in the broadest sense. The small plate considered here is not necessarily flat and does not necessarily extend in one plane, the obverse and reverse faces are not necessarily parallel to each other or planar.

The noted length Lzz taken along the longitudinal axis X1 may typically be the distance that separates the proximal reference point (PrZp) from the distal reference point (PrZd).

It should be noted that the qualifier 'digital' in the term digital support refers to fingers and not to numerical signals or computer entities.

According to one advantageous aspect, the proximal bearing zone (ZAP) is such that the section of the part at this location is generally concave. Such a shape naturally hugs the pad of the finger and this procures a certain retention effect on the proximal side.

According to one advantageous aspect, the proximal bearing zone (ZAP) is such that the section of the part at this location comprises a concave section. Such a shape naturally hugs the pad of the finger and this procures a certain retention effect on the proximal side.

In various embodiments of the invention, one and/or the other of the following arrangements, taken alone or in combination, may further be resorted to.

According to one interesting option, the small plate may have a substantially constant thickness. This procures ease of manufacture and right/left reversibility by simply turning over the projectile part.

According to one option, the mass of the projectile may be less than 2 grams. According to one option, the mass of the projectile part may be less than 1 gram. This makes it possible to obtain long throws including for children's hands.

According to one option, the reference length Lzz of the projectile part may be less than 45 mm. In this way, the projectile part is easy to place. In addition, the projectile part is compact and one or more projectile parts may be stored in a small volume.

According to one option, the reference length Lzz may be less than 40 mm or even less than 35 mm.

According to one option, the first dimensional ratio RD1 may be between 30% and 90%.

According to one option, the first dimensional ratio RD1 may be between 45% and 75%.

According to one option, a second dimensional ratio RD2=E4/L21 is defined, where E4 is the minimum width of the escapement strip and L21 is the orifice width along the first orifice axis (A1), the second dimensional ratio RD2 being between 10% and 60%.

According to one option, the minimum width (E4) of the escapement strip is such that the second dimensional ratio RD2 may be between 10% and 50%. According to one particular solution, the second dimensional ratio RD2 may be between 10% and 40%.

According to one option, the minimum width (E4) of the escapement strip may be between 2 mm and 6 mm.

This forms a compromise between the total size of the projectile part and the position of the orifice receiving the thumb. The position of the through orifice is thus away from the proximal bearing zone, at an optimal distance, while retaining a sufficient strip of material on the distal side so that the robustness of the part is correct and the integrity of the product is preserved, under throwing efforts or stacking and storage efforts. When throwing, a balance is sought between the linear speed and the rotation rate of the projectile part.

According to one option, an isoperimetric quotient equal to Q1=[4π×Aire1/Perim2] is defined for the outer contour of the projectile part and the surrounded surface, with Perim representing the perimeter of the outer contour and Aire1 representing the surface surrounded by the outer contour, and the projectile part is such that Q1 is greater than 0.6.

According to one option, Q1 may be between 0.7 and 0.9.

According to one option, a second quotient noted Q2 may be defined for the outer contour of the projectile part and the surrounded surface, with Q2=ECI/Aire1, where Aire1 represents the surface surrounded by the outer contour and ECI represents the surface of the largest disk (PDI) inscribed inside the outer contour. According to one option, Q2 may be greater than 0.5.

According to one option, the largest dimension (Lmax) of the projectile part is less than 60 mm, preferably less than 50 mm and even more preferably less than 40 mm.

According to one option, the through orifice (2) may have a height (L22) along a second orifice axis (A2) perpendicular to the first orifice axis, and the height is smaller than the width. In other words L22<L21.

According to one option, the height of the through orifice may be less than 75% of its width. In other words L22<0.75 L21.

L22 may also be chosen between 50% and 70% of L21.

According to one alternative option, the through orifice (2) may have an elliptical shape. An oval, ovoid or even circular shape is also considered.

According to one option, the front portion of the orifice may be arc of circle shaped with a first radius of curvature (R1) and the rear portion (24) of the through orifice (2) may have a second radius of curvature (R2), and the first radius of curvature (R1) is larger than the second radius of curvature.

According to one option, the front portion of the orifice may be concave and arc of circle shaped with a first radius of curvature (R1) and the rear portion (24) of the through orifice (2) may be concave, with a second radius of curvature (R2), and the first radius of curvature (R1) is larger than the second radius of curvature.

According to one option, the first radius of curvature may be greater than 14 mm, the edge being able to be concave or convex.

According to one option, the second radius of curvature (R2) may be between 6 mm and 14 mm.

According to one option, the orifice contour is a closed contour. This procures worthwhile sturdiness and esthetic appeal, as opposed to a contour interrupted by a notch.

According to one option, the distal bearing zone (ZAD) may comprise a distal protrusion (32) forming a bearing on a distal phalanx of the digital support. This forms a tactile mark; this allows easier control of the effort dosage on the distal side.

According to one option, the proximal bearing zone (ZAP) may comprise at least one front proximal protrusion (33). This forms a tactile mark; the projectile part may easily be installed in a straddling posture on the pad of the finger.

According to one option, the proximal bearing zone may be such that the section of the part at this location is generally concave between the rear proximal protrusion and the front proximal protrusion. Such a shape naturally hugs the pad of the finger, the two protrusions may be placed straddling a finger.

According to one option, the proximal bearing zone may preferably be in an arc of circle. Easy to manufacture, pleasant to look at, practical to use, durable, natural shape. A shape is chosen that naturally hugs the pad of the finger.

According to one option, said radius of curvature (R3) may be between 0.5 cm and 25 cm.

According to one option, the intermediate bearing zone (ZAI) is interposed between the proximal bearing zone (ZAP) and the distal bearing zone (ZAD) according to a substantially straight line arrangement. Whereby the through orifice is arranged on the rear side of the projectile part and the useful propulsion travel imparted by the thumb may be as long as possible.

According to one option, the midpoint BP of the apexes of the proximal protrusions is marked, and the shape of the part is such that the longitudinal axis X1, which passes through the proximal reference point (PrZp) of the proximal bearing zone and the distal reference point (PrZd) of the distal bearing zone, also passes substantially through the midpoint BP of the apexes of the proximal protrusions.

According to another inverted perspective, the proximal reference point (PrZp) may be defined as the intersection of the proximal edge with the straight line that connects the midpoint BP of the apexes of the proximal protrusions and the distal reference point (PrZd) or even the apex of the distal bearing zone (ZAD) when a distal protrusion exists.

According to one option, the projectile part is such that at least 70% of the surface of the through orifice (2) is located to the rear of the longitudinal axis. Whereby the through orifice is arranged on the rear side of the projectile part and the useful propulsion travel imparted by the thumb may be as long as possible.

According to one option, the center of mass (G) of the projectile part is located near the proximal end of the intermediate bearing zone (ZAI). Thus, the through orifice is globally located between the center of mass and the distal bearing zone, the orifice is away from the proximal edge and offset from the center of mass to be able to impart the rotation on itself of the projectile part. An increase in rotation is advantageously obtained even after release of the ZAP, (cf. phase W4, FIG. 8).

According to one option, the projectile part may be formed by cutting from a substantially flat blank. It is noted that such an object may be inexpensive to manufacture, notably in a context of mass or even large-scale manufacture.

According to one option, the projectile part may be formed from a substrate material coated with a decorative sheet on the obverse side or the reverse side or on both sides. Such a printed sheet allows the appearance of the projectile part to be customized.

According to one option, the projectile part may be obtained from molding.

According to one option, the projectile part may be made of plastic.

According to one option, the projectile part may be obtained by laser cutting and decoration, notably of wood.

According to one option, the projectile may be curved, i.e. not flat.

According to one option, a projecting relief may be provided on the projectile part, outside the plane of the small plate. This may be a tactile mark or a shape forming part of an illustration or image printed on the face of the part with 3D effect.

According to one option, the outer contour may be continuous, without singular point or angular corner. In this way, the projectile part does not get caught in the pockets of clothes.

According to one option, the projectile part may be formed from rigid paper or cardboard type material. The weight per unit area of the material forming the projectile part is between 400 g/m$^2$ and 5000 g/m$^2$.

According to one option, the weight per unit area may preferably be between 700 g/m$^2$ and 1500 g/m$^2$. This is an optimum with sufficient sturdiness and optimum mass for use as a projectile.

According to one option, the projectile part may be formed from wood. It is possible to use agglomerated particles or plywood.

According to one option, the first orifice axis (A1) is defined as the axis passing through the furthest points (P1, P2) of the contour of the through orifice.

The outer contour has a general longitudinal axis X1 which may be defined as extending between the midpoint BP of the apexes of the proximal protrusions and the apex of the distal protrusion.

According to one option, the first orifice axis (A1) is oriented angularly with respect to the longitudinal axis X1, regardless of its definition variant, by an angle [3 between 0° and 35°, or even between 0° and 30°.

According to one option, the width of the orifice L21 may be greater than 10 mm and preferably be between 12 mm and 24 mm, or even preferably between 13 mm and 19 mm. The width must be sufficient to accommodate the tip of the thumb without lateral entrapment effect.

According to one option, the height of the orifice L22 may be between 5 mm and 15 mm and preferably between 7 mm and 13 mm. This forms a stop for the tip of the thumb and prevents the excessive insertion and entrapment of the pad of the thumb in the orifice.

According to one option, the total surface Aire1 occupied by the part (including the orifice zone) may be between 6 cm$^2$ and 9 cm$^2$, preferably between 6 cm$^2$ and 8 cm$^2$.

According to one option, the surface of the orifice SF2 may be between 1 cm$^2$ and 2.5 cm$^2$.

According to one option, a third dimensional ratio RD3=SF2/Aire1 is defined. According to one option, RD3 may be between 0.1 and 0.4. According to another option, RD3 may be between 0.15 and 0.25.

According to another aspect, the present invention also relates to a method for throwing a projectile part presenting as a small plate with a thickness and an outer contour, the latter comprising a front edge (11) on the side of the projection direction and a rear edge (12) on the opposite side, the projectile part comprising a proximal bearing zone (ZAP) intended to receive the pad of a first phalanx of a digital support of a hand (M) of a user, a distal bearing zone (ZAD) intended to bear on another phalanx of a digital support, a through orifice (2) arranged away from the proximal bearing zone, said orifice having an orifice contour with a front portion (20) forming an intermediate bearing zone (ZAI), the method comprising:

/a/ placing the proximal support zone (ZAP) bearing on at least one first phalanx of the digital support, /b/ placing the distal support zone (ZAD) bearing on at least one other phalanx of the digital support, /c/ placing the thumb in the through orifice (2) with the thumbnail bearing on the intermediate bearing zone (ZAI), /d/ exerting an effort at least forwards with the thumb while maintaining the digital support against the proximal and distal bearing zones (ZAP, ZAD), /e/ allowing a slip to occur (at least at the level of the distal bearing zone (ZAD)) to cause the release of said distal bearing zone (W2) and the forward projection of the projectile part (W2, W3, W4), with simultaneous rotation induced by the delayed release of the proximal bearing zone (ZAP).

According to one option, the proximal bearing zone (ZAP) comprises at least one rear proximal protrusion (31), forming a rear retainer on the proximal side. This makes it easier to position and throw the projectile part.

According to one option, in step/d/, an equilibrium of the forces (PP, FRD, FRP) exerted on the projectile is maintained, with a sum PP+FRD+FRP near zero.

According to one option, the insert has a section, an obverse face and a reverse face, and the support zones, respectively proximal and distal (ZAP, ZAD), may extend on the section and on the reverse face as well as on the rims connecting the reverse face to the section.

According to one option, the intermediate bearing zone (ZAI) extends along a rim connecting the obverse face to the section. The nail is bearing obliquely, bearing linearly occasionally.

According to one option, the intermediate bearing zone (ZAI) extends over the section and on the obverse side as well as on the rim connecting the reverse side to the section.

According to one option, the method and the projectile part are such that a same projectile part may be thrown either by a left hand or by a right hand of individuals, and in the case where the projectile part is not symmetrical with respect to a median plane PXZ, it is sufficient to turn over the part to switch from left to right hand or vice versa.

BRIEF DESCRIPTION OF THE DRAWINGS

Other aspects, aims and advantages of the invention will appear upon reading the following description of an embodiment of the invention, given by way of non-limiting example. The invention will also be better understood with regard to the attached drawings in which:

FIG. 12 illustrates in more detail an exemplary through orifice.

FIG. 13, declined in FIGS. 13A and 13B, schematically illustrates the placement of the projectile part on the digital support in preparation for throwing.

FIG. 14 illustrates, in plan view, a sixth embodiment of the projectile part to be thrown.

In the different figures, the same references designate identical or similar elements. For reasons of clarity of the presentation, some elements may not be represented to scale.

In the present document, the terms 'proximal' and 'distal' designate finger entities respectively closer and less close to the palm of the hand. With regard to the projectile part, the term 'longitudinal direction' designates a direction generally passing through the proximal and distal bearing zones. A more precise definition could be given later.

In the present document, the term 'forward' designates the direction in which the projectile part is thrown or projected, and the term 'backward' means the direction opposite to the forward direction.

As illustrated in the figures, a projectile part 1 to be thrown by the fingers of a hand M of a user is presented. This can be either the right or left hand.

For a given hand, F0 is the thumb, F1 is the index finger, and F2 is the middle finger. The term "digital support" designates one or more inner zones of the fingers F1, F2, i.e. either the index finger or the middle finger or both. The ring finger may also contribute to the digital support.

The dorsal faces of the phalanxes are not used except the nail (or even the back) of the thumb F0. In practice, the digital support considered here uses the pads of the fingers on the palmar side.

Shape Generalities

In the illustrated examples, the projectile part 1 presents itself as a small plate having a thickness E1. The thickness may vary slightly. It is not excluded to have a projection outside of the plane of the small plate.

Figure 6:
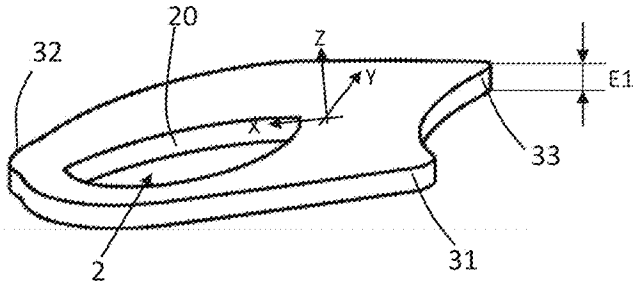
FIG. 6 illustrates, in perspective, the projectile part according to the first embodiment, FIG. 7, declined in FIGS. 7A 7B 7C 7D 7E 7F, shows views illustrating the throwing sequence to throw the projectile part according to the first embodiment.

In embodiments of interest, the small plate has a substantially constant thickness E1 (cf. FIG. 6).

In general, the general thickness E1 is between 0.3 mm and 5 mm.

In embodiments of interest, the general thickness E1 is between 1 mm and 2 mm.

The projectile part 1 is delimited by an outer contour, the latter comprising a front edge 11 on the side of the projection direction and a rear edge 12 on the opposite side. To complete the contour, a proximal edge 10 and a distal edge 13 are provided.

The projectile part 1 comprises an obverse side and a reverse side connected to each other by a section that forms the contour. By convention, the obverse face will be the face arranged upwards when the projectile part is thrown with the right hand.

Thus, the obverse face is the face arranged upwards when the projectile part 1 is placed such that the rear proximal protrusion 31 (defined hereafter) is located at the bottom right and the reverse face will be the face arranged upwards when the projectile part 1 is placed such that the rear proximal protrusion 31 is located at the bottom left.

In embodiments of interest, the outer contour is continuous, without singular point or angular corner. The tangent evolves continuously, without jumping.

G designates the center of mass of the projectile part.

G' is the barycenter of the unpierced projectile part, i.e. the barycenter of the entire zone surrounded by the outer contour of the projectile part. This barycenter is visible in FIGS. 2 and 16, the utility will be seen later.

In embodiments of interest, the projectile part 1 is formed by cutting from a substantially flat blank.

Alternatively, the projectile part 1 may be obtained from molding.

Alternatively, the projectile part 1 may be curved, i.e. not flat. In other words, there may be a more or less pronounced 3D effect in the shape of the projectile part.

In embodiments of interest, the projectile part is formed from cardboard type material.

In embodiments, the projectile part is formed from plastic material.

Typically, the weight per unit area will be between 400 $g/m^2$ and 5000 $g/m^2$.

In embodiments of interest, the weight per unit area is between 700 $g/m^2$ and 1500 $g/m^2$.

Alternatively, the projectile part 1 may be formed from wood or derived material. Alternatively, the projectile part 1 may be formed from any other material, leather, plant material, recycled material. The projectile part 1 may be formed from any plastic material.

The projectile part 1 comprises a through orifice 2 which will be described in detail later.

The projectile part 1 comprises a proximal bearing zone (ZAP) intended to receive at least one phalanx of the digital support, a distal bearing zone (ZAD) intended to bear on at least one other phalanx of the digital support.

The proximal bearing zone ZAP may contact the proximal or intermediate phalanx of the index finger F1 or the proximal or intermediate phalanx of the middle finger F2 or several of the aforementioned phalanxes at the same time.

The proximal support zone ZAP encompasses portions that are located on the section of the projectile part but also encompasses lower surfaces (reverse face side to throw right hand) as well as the rims connecting the lower surfaces to the section.

Advantageously, the proximal bearing zone ZAP comprises at least one rear proximal protrusion 31.

Figure 1:
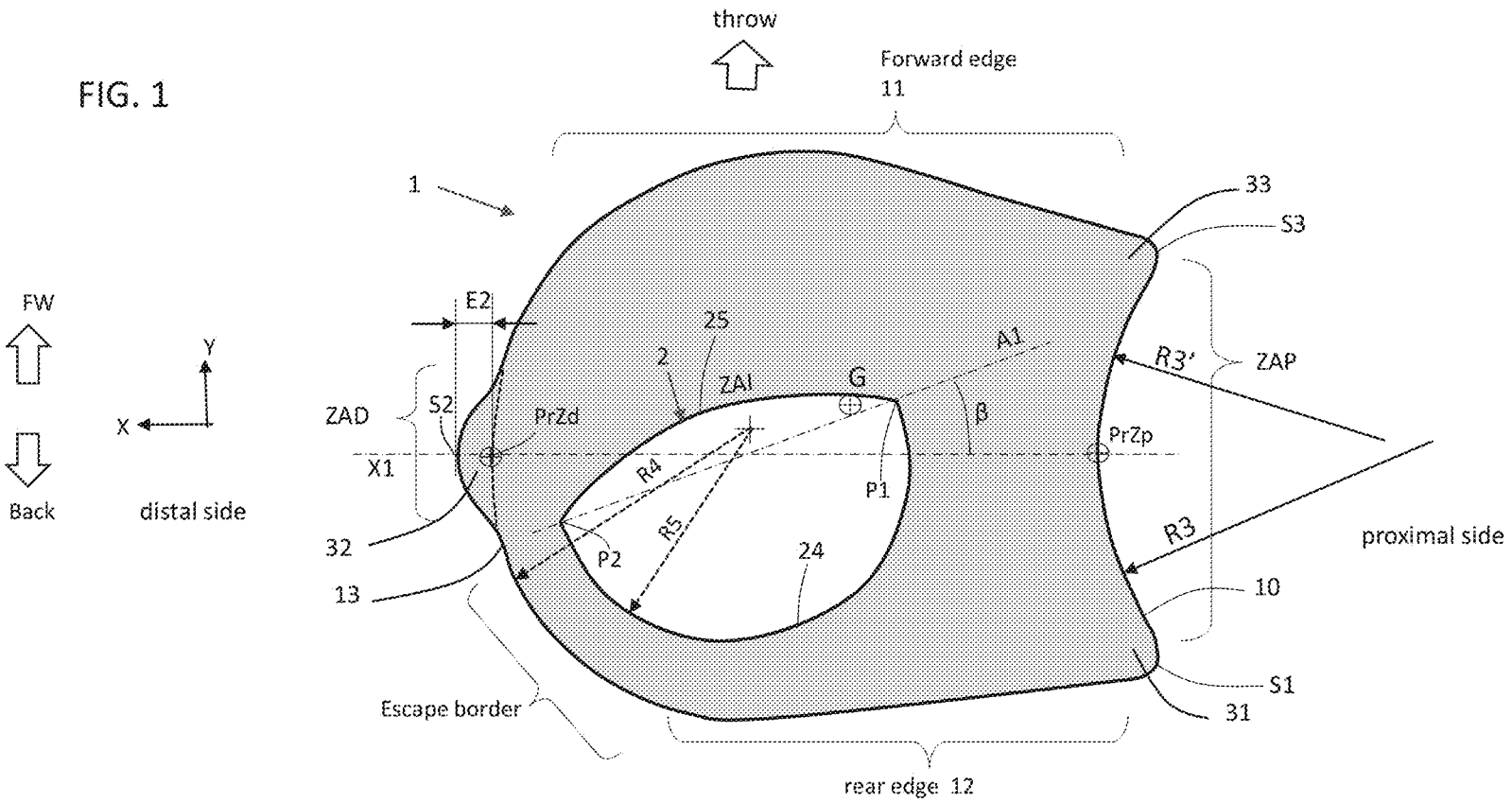
FIG. 1 illustrates, in plan view, a first embodiment of the object to be thrown ('projectile part') according to the present invention.

'Protrusion' is here taken to mean a bump (or a projection or an excrescence) extending in the plane of the part. Geometrically, the protrusion is characterized by a local maximum distance in reference to the center of mass G. The local maximum is called apex S1 (cf. FIGS. 1 and 2). For example, the protrusion has an increased distance with respect to G between 2% and 20%, more preferably for example between 4% and 12%. According to another perspective, the protrusion protrudes radially outwardly with respect to adjacent zones located tangentially on either side of said protrusion.

In addition, it should be noted that protrusion also encompasses a projecting shape that protrudes above the obverse face or below the reverse face of the small plate.

The rear proximal protrusion 31 procures a retention effect during the throwing process as will be seen later.

The distal bearing zone ZAD may contact the distal or intermediate phalanx of the index finger F1 or the distal or intermediate phalanx of the middle finger F2 or several of the aforementioned phalanxes at the same time.

The distal bearing zone ZAD encompasses portions that are located on the section of the projectile part but also encompasses lower surfaces (reverse face side to throw right hand) as well as the rims connecting the lower surfaces to the section.

A proximal reference point PrZp is defined on the proximal edge 10 that forms the proximal bearing zone ZAP. A distal reference point PrZd is defined on the distal edge 13 of the distal bearing zone. A longitudinal axis X1 is defined which extends between the proximal reference point PrZp and the distal reference point PrZd. Along said longitudinal axis X1, the projectile part has a reference length noted Lzz.

The positions of the proximal PrZp and distal PrZd reference points are defined according to the considered alternatives of the projectile part.

In practice, it is noted that the distal bearing zone ZAD covers several millimeters on either side of the axis X1 and extends slightly more forward than backward.

Generally, a direction perpendicular to the forward-backward direction and parallel to a general proximal-distal orientation will be taken as the direction of the longitudinal axis X1. And in the absence of other geometric marks that will be seen hereafter, with reference for example to FIG. 4, the proximal PrZp and distal PrZd reference points may be chosen as the intersections of the longitudinal axis X1 with the respective proximal and distal edges, for a longitudinal axis X1 spaced from the rear edge 12 by a distance L12b of 12.5 mm.

In relation to the barycenters, an alternative definition for determining the proximal PrZp and distal PrZd reference points, and the axis X, will be seen later.

The reference length Lzz separates the proximal PrZp and distal PrZd reference points. The reference length Lzz is less than 49 mm. According to one embodiment, the reference length Lzz may be less than 45 mm, or even less than 40 mm, or even less than 35 mm. The projectile part is thus easy to place on the digital support. The reference length Lzz is preferably greater than 20 mm. An optimum may be chosen at 27 mm.

In embodiments of interest, the distal bearing zone (ZAD) may comprise a distal protrusion 32. The distal protrusion 32 has an apex noted S2.

The distal protrusion 32 forms a bearing on a distal or intermediate phalanx of the digital support. The distal protrusion 32 procures a retention effect during the throwing process as will be seen later. The distal protrusion 32 forms a tactile mark and allows easier effort dosing.

The distal protrusion 32, by the small retention effect it procures, enables a greater potential energy accumulation prior to detachment (i.e. the transition from static friction to dynamic friction). A higher potential energy enables a greater acceleration. Further, a short distal protrusion 32 will reduce the distance and friction time so as to minimize the energy loss caused by dynamic friction following detachment.

The distal protrusion 32 forms an overshoot of E2 relative to a primitive circle or a 2nd order polynomial curve generally inscribed on the distal edge. E2 is preferably between 0.25 mm and 3 mm. In one particular embodiment, the overshoot E2 is close to 1 mm.

For the positioning of the distal reference point PrZd, the protrusion 32 is disregarded and the distal reference point PrZd is slightly recessed (from E2) inwards with respect to the distal edge 13 of the distal bearing zone (visible in FIGS. 1-3, 9, 10 and 14). To disregard the protrusion 32, an arc of circle inscribed on the central zone of the distal edge is used as illustrated in dotted lines in the figures.

In embodiments of interest, the proximal bearing zone ZAP comprises a front proximal protrusion 33, functionally complementary to the rear proximal protrusion 31. The front proximal protrusion 33 has an apex noted S3.

The two protrusions form a good tactile mark; the proximal edge is placed straddling the pad of the finger.

The proximal bearing zone may be such that the section of the part at this location, i.e. the proximal edge, is generally concave between the rear proximal protrusion 31 and the front proximal protrusion 33. The proximal edge may be arc of circle shaped.

Any generally concave shape may be suitable. The radius of curvature R3 is not necessarily constant but may vary R3'. For example, radii between 1 cm and 10 cm may be selected without this being limiting.

A proximal midpoint BP is defined, forming the middle of the apexes of the proximal protrusions S1, S3.

In these conditions, for the projectile part and its outer contour, the general longitudinal axis X1 is defined as extending between the midpoint BP of the apexes of the proximal protrusions S1, S3 and the apex S2 of the distal protrusion.

The proximal reference point PrZp is then at the intersection of the longitudinal axis X1 with the proximal edge.

Figure 3:
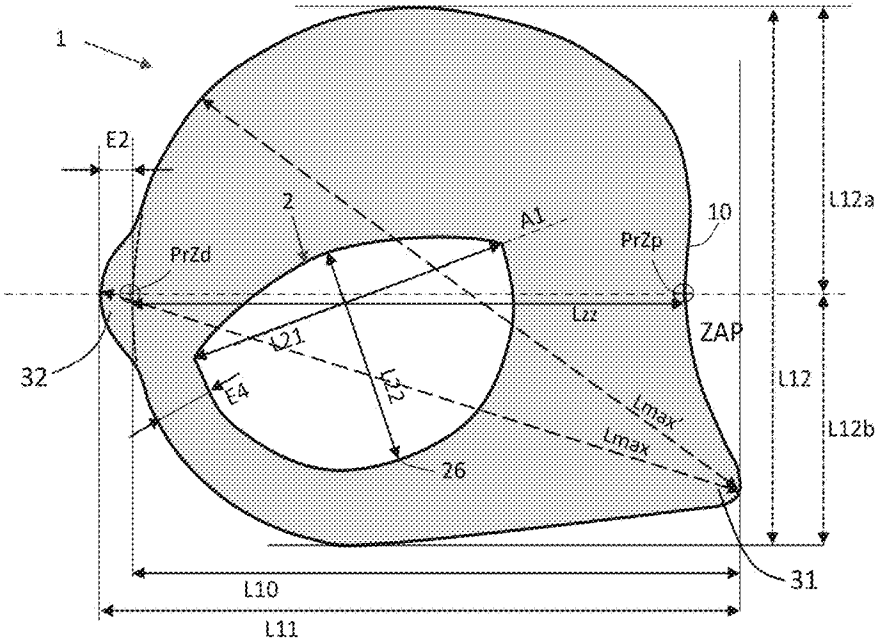
FIG. 3 illustrates, in plan view, a second embodiment of the projectile part to be thrown.

In FIG. 3, in the alternative represented, there is no front protrusion on the proximal side.

Figure 4:
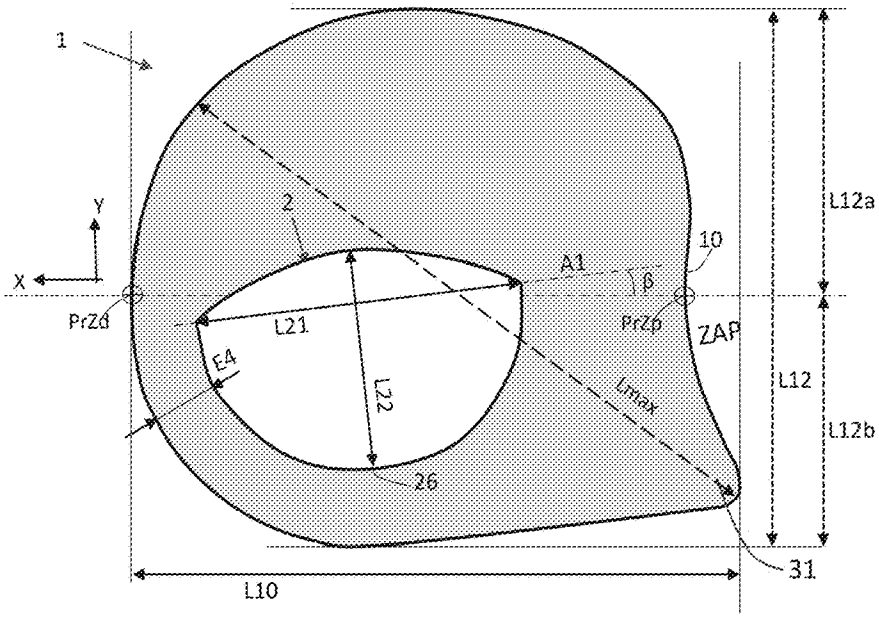
FIG. 4 illustrates, in plan view, a third embodiment of the projectile part to be thrown, FIG. 5, declined in FIGS. 5A 5B 5C, shows plan, longitudinal and cross-sectional views, respectively, with the projectile part according to the first embodiment in the throwing situation.

In FIG. 4, in the alternative represented, there is no protrusion on the distal side and there is no front protrusion on the proximal side.

Concerning other dimensions appearing in the figures, L10=Lzz+distance (BP-PrZp); L11=overall dimension along X1, in practice between Lzz and Lzz+5 mm.

With reference to FIGS. 1-4, 9, 10, 14, for the dimensions in the forward-backward direction, in a particular case, L12a is chosen in a range [12 mm-20 mm], or even in a range [12 mm-15 mm]. In one particular case, L12b is chosen within a range [12 mm-15 mm], In one particular case, their sum L12 is chosen in a range [24 mm-35 mm] or even in a range [25 mm-30 mm], In one particular case, the outer contour may have a front-rear symmetry, i.e. a symmetry with respect to the plane X1-Z.

In general, the mass of the projectile part is less than 7 grams. In preferred embodiments, the mass of the projectile part is less than 5 grams.

Preferably, the mass of the projectile part may be less than 2 grams. According to a preferred option, the mass of the projectile part may be less than 1 gram.

The largest dimension of the projectile part is noted Lmax (or even Lmax'). (cf. FIGS. 2, 3, 4).

In general, Lmax<60 mm. Preferably, Lmax will be less than 50 mm, or even less than 40 mm.

Figure 15:
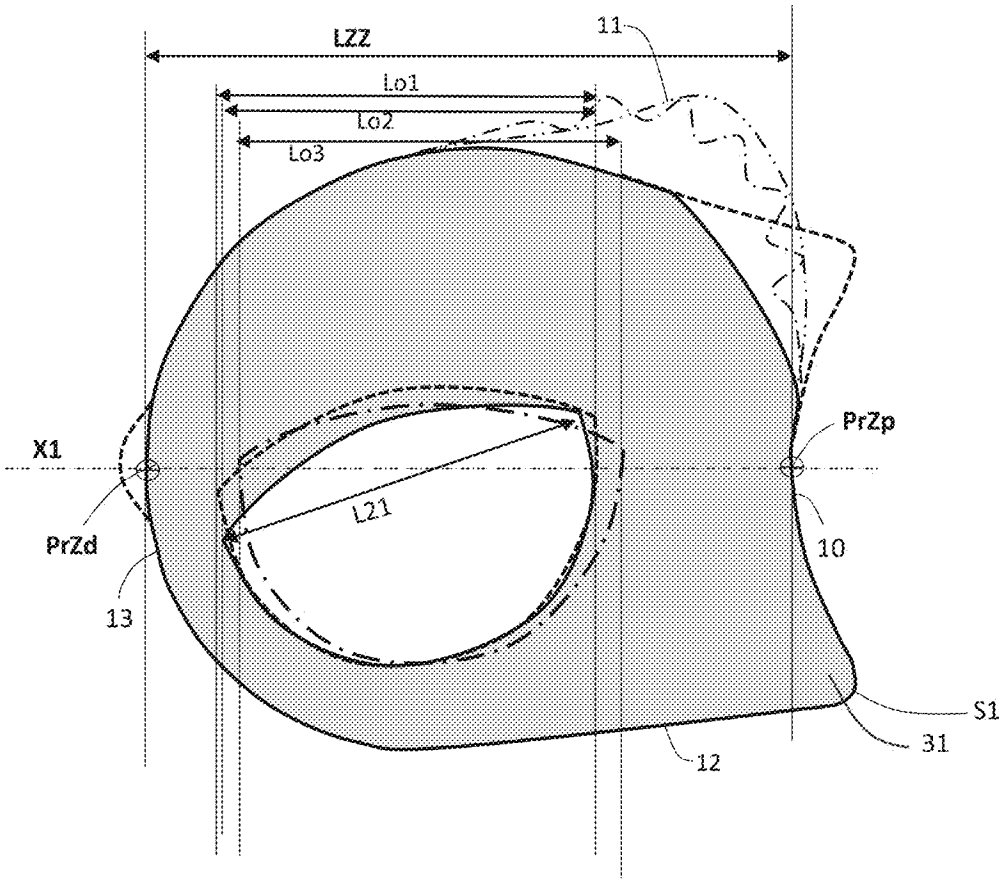
FIG. 15 illustrates, in plan view, embodiment alternatives highlighting certain dimensions of the projectile part to be thrown.

As illustrated in FIGS. 14 and 15, the front edge 11 is free shape, the front edge 11 may comprise wavy and diverse shapes, more or less protruding forward. This allows the projectile part to be customized to make it resemble a silhouette of a known object or character.

An isoperimetric quotient equal to Q1=[4π×Aire1/Perim2] is defined for the outer contour of the projectile part, where Perim represents the perimeter of the outer contour (which is squared in the formula) and where Aire1 represents the surface surrounded by the outer contour.

The projectile part is such that Q1 is greater than 0.6.

According to one embodiment, Q1 may be between 0.7 and 0.9.

Figure 17:
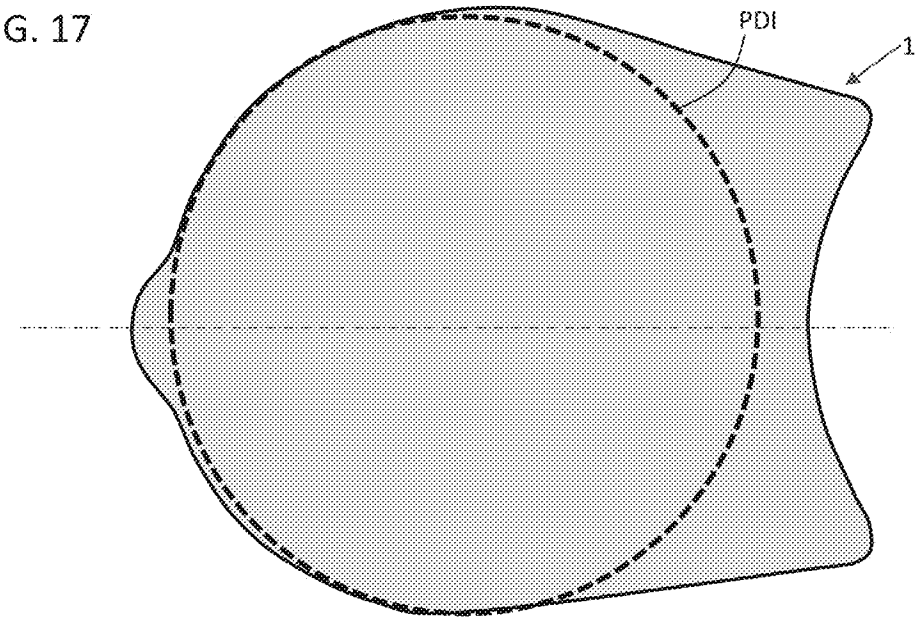
FIG. 17 schematically illustrates elements making it possible to calculate the second dimensional quotient Q2.

Furthermore, a second quotient noted Q2 is defined. With reference to FIG. 17, a particular disk is defined as the largest disk PDI inscribed inside the outer contour of the projectile part. The surface of this larger disk is noted ECI. Aire1 represents the total surface surrounded by the outer contour (unpierced orifice part).

The second quotient Q2 is expressed by Q2=ECI/Aire1. In embodiments of interest, Q2 may be greater than 0.5. In preferred embodiments, one may have Q2 may be between 0.6 and 0.85.

A fourth quotient Q4 is defined and expressed by Q4=ECITR/AireTR1. ECITR is the surface of the largest disk inscribed, truncated as explained below for AireTR1. AireTR1 represents an area truncated along the straight line U3 (FIG. 16), i.e. the total surface surrounded by the outer contour (unpierced orifice part) from which all that protrudes by more than 12.5 mm forwards with respect to the axis X1 is removed (i.e. Aire1 from which any projection of more than 12.5 mm forwards in relation to the X1 axis is removed).

In embodiments of interest, Q4 may be greater than 0.5. In preferred embodiments, Q4 may be between 0.6 and 0.85.

It may be considered that Q1, Q2 and Q4 are characteristics of shape factors of the projectile part.

Through Orifice

Figure 5A:
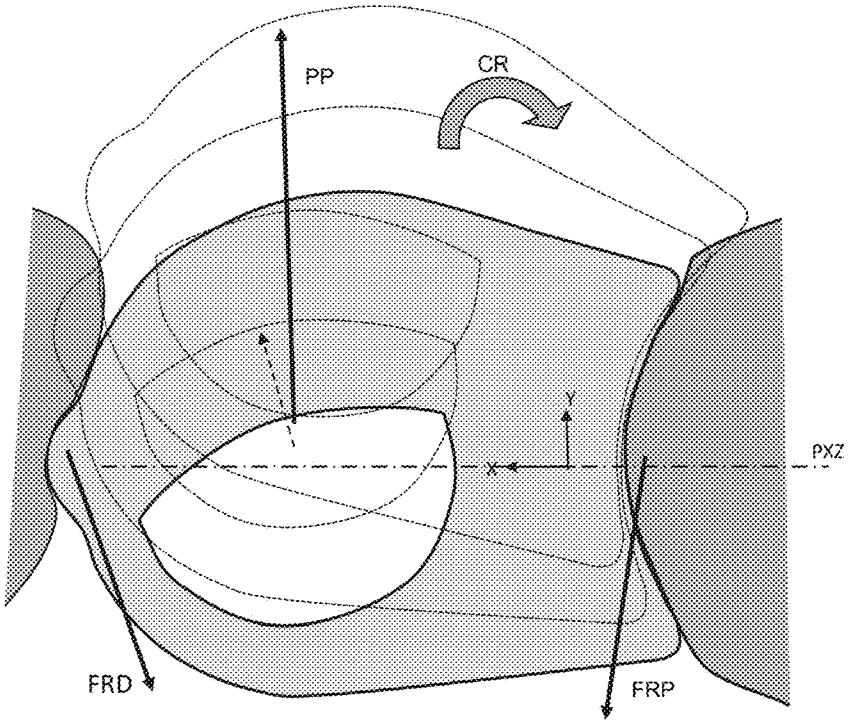

The through orifice 2 is arranged away from the proximal bearing zone, which makes it possible to impart a rotation torque (mark CR, FIG. 5A) in a clockwise direction (viewed from above, right hand).

The through orifice has an orifice contour with a front portion 20 and a rear portion 24. The front portion 20 forms an intermediate bearing zone (ZAI) intended to receive a propulsion force formed by a bearing of the flat of the thumbnail F0. The rear portion 24 is intended to receive the tip of the thumb, as illustrated notably in FIG. 11.

The rear portion 24 forms a stop for the tip of the thumb, it prevents the thumb from sinking too far into the through orifice 2. Note that the thumb F0 must be sufficiently sunken in to be able to apply a propulsion force over a sufficient travel, but not too sunken in so that at the end of the movement (i.e. after PP3 FIG. 11 and during W3 cf. FIG. 8) the thumb can escape quickly and easily from the through orifice 2 so that its pad does not brake the projectile part. This enables powerful, fast and smooth throws.

The intermediate support zone encompasses the section of the front portion. It may also encompass the upper surface as well as the rim 27 or the rims connecting the upper surface to the section.

Figure 10:
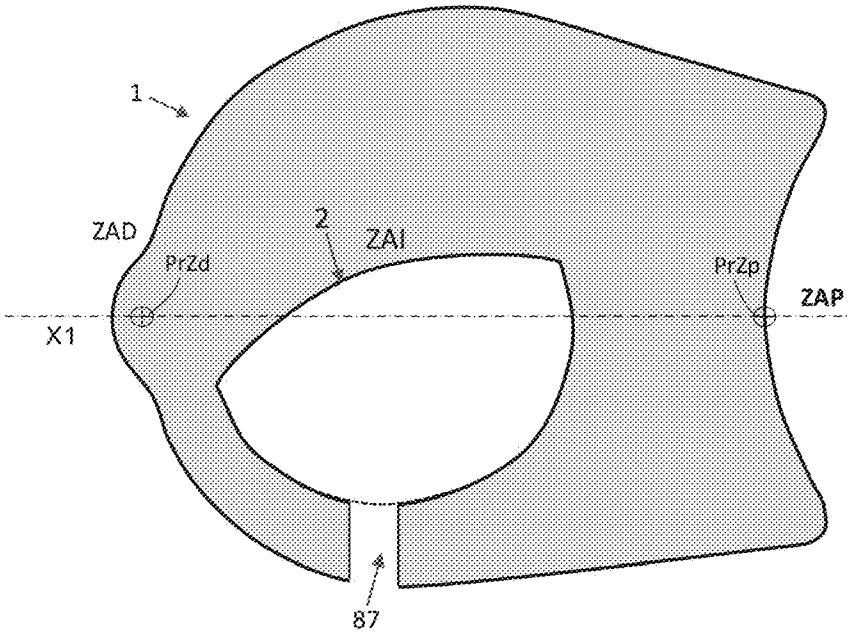
FIG. 10 illustrates, in plan view, a fifth embodiment of the projectile part.

In embodiments of interest, the orifice contour is a closed contour, as illustrated in all the figures except FIG. 10.

However, a discontinuity as illustrated in FIG. 10 is not excluded. In this case, a notch 87 extends between the rear edge and the through orifice 2. The notch could be positioned towards the front edge or somewhere else.

In embodiments of interest, the first orifice axis A1 may be defined as the axis passing through the furthest points (P1, P2) of the contour of the through orifice. A second orifice axis A2 perpendicular to the first orifice axis is then defined.

The first point P1 is the proximal corner of the orifice 2.

The second point P2 is the distal corner of the orifice 2.

The front portion 20 has an apex 25, the point furthest from the first axis A1.

The rear portion 24 has an apex 26, the point furthest from the first axis A1.

According to one embodiment, the center of mass is located near the first point P1. According to one embodiment, the distance between the center of mass and the first point P1 is less than 5 mm.

As illustrated in the figures, the first orifice axis A1 is oriented angularly to the longitudinal axis by an angle β with respect to the general longitudinal axis X1

According to one embodiment, the angle β is between 0° and 35°, or even between 0° and 30°.

According to another embodiment, the angle β is between 0° and 20°.

For example, it is noted that in FIG. 4, the angle β is smaller than that represented in FIG. 3.

The through orifice 2 has an orifice width noted L21 along the transverse direction of the orifice, i.e. along the first orifice axis A1.

The through orifice 2 has a height noted L22 along the second orifice axis A2. In the figures, the height is the distance that separates the two apexes (front 25 and rear 26) of the orifice 2.

In general, the height is smaller than the width. In other words L22<L21. The height L22 is such that the rear edge 24 forms a stop for the tip of the thumb and prevents the excessive insertion and the entrapment of the pad of the thumb in the orifice 2.

In some embodiments of interest, the height of the through orifice may be less than 75% of its width. In other words L22<0.75×L21. A range such as 0.45×L21<L22<0.75×L21 may be chosen.

The through orifice 2 is separated from the distal edge by a strip of material called escapement strip and marked 4. The escapement strip has a minimum width noted E4, and is delimited outwards by the escapement curve and marked 14.

If the escapement strip is run along its path L4 (cf. FIG. 2), the width may change, and the narrowest point is considered, which therefore has the minimum width noted E4.

In one particular case, the escapement strip has a curved outer edge, substantially concentric with the local contour of the orifice. More precisely, the radius of curvature R4 of the outer edge and the radius of curvature R5 of the inner edge of the opposite orifice have neighboring reference points. In this case, the width of the escapement strip 4 is substantially constant over the travel L4.

Note that the minimum width noted E4 is less than the orifice width L21. In some embodiments of interest, the minimum width E4 is less than 75% of the orifice width L21. In other embodiments of interest, the minimum width E4 is less than 50% of the orifice width L21. In other embodiments of interest, the minimum width E4 is less than 6 mm. In other embodiments of interest, the minimum width E4 is less than 5 mm. The protrusion 32 is excluded from the preceding dimensional considerations.

A second dimensional ratio RD2=E4/L21 is defined, where E4 is the minimum width of the escapement strip and L21 is the orifice width along the first orifice axis (A1), the second dimensional ratio RD2 being between 10% and 60%.

In some embodiments of interest, the second dimensional ratio RD2 may be between 10% and 50%. According to a particular solution, the second dimensional ratio RD2 may be between 10% and 40%.

In some embodiments of interest, illustrated using FIG. 12, the front portion 20 of the orifice is concave and arc of circle shaped with a first radius of curvature R1, the dotted line marked 20' denotes one alternative from an infinite number of possibilities.

The rear portion 24 of the through orifice 2 may be concave, with a second radius of curvature R2. The first radius of curvature R1 is larger than the second radius of curvature R2.

In some embodiments, the first radius of curvature R1 may be greater than 10 mm.

In some embodiments, the second radius of curvature R2 may be between 5 mm and 15 mm.

In one particular embodiment, illustrated in FIG. 14, the orifice may have a circular shape. In this case L21=L22 represents the diameter.

Figure 9:
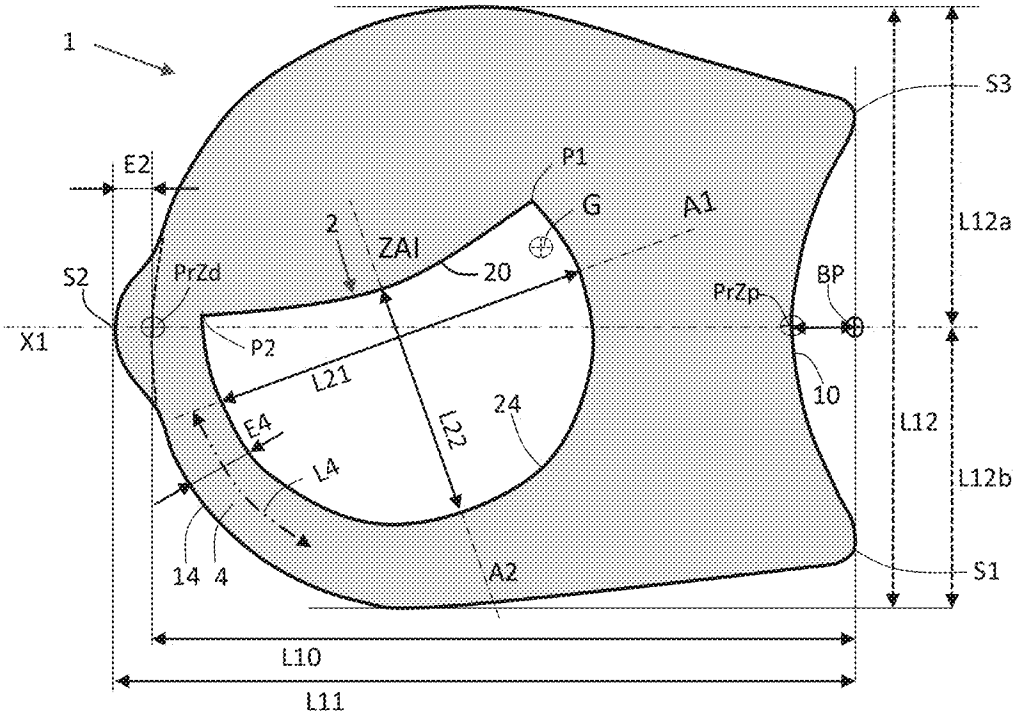
FIG. 9 illustrates, in plan view, a fourth embodiment of the projectile part.

In FIG. 9, in the alternative represented, the curvature of the front portion 20 of the orifice is reversed. It is therefore understood that the front portion 20 of the orifice may be concave or convex. It should receive the pushing of the thumbnail without the tip of the thumb being entrapped, either laterally or in the forward-backward direction.

Alternative Definition of the Longitudinal Axis X1

Figure 2:
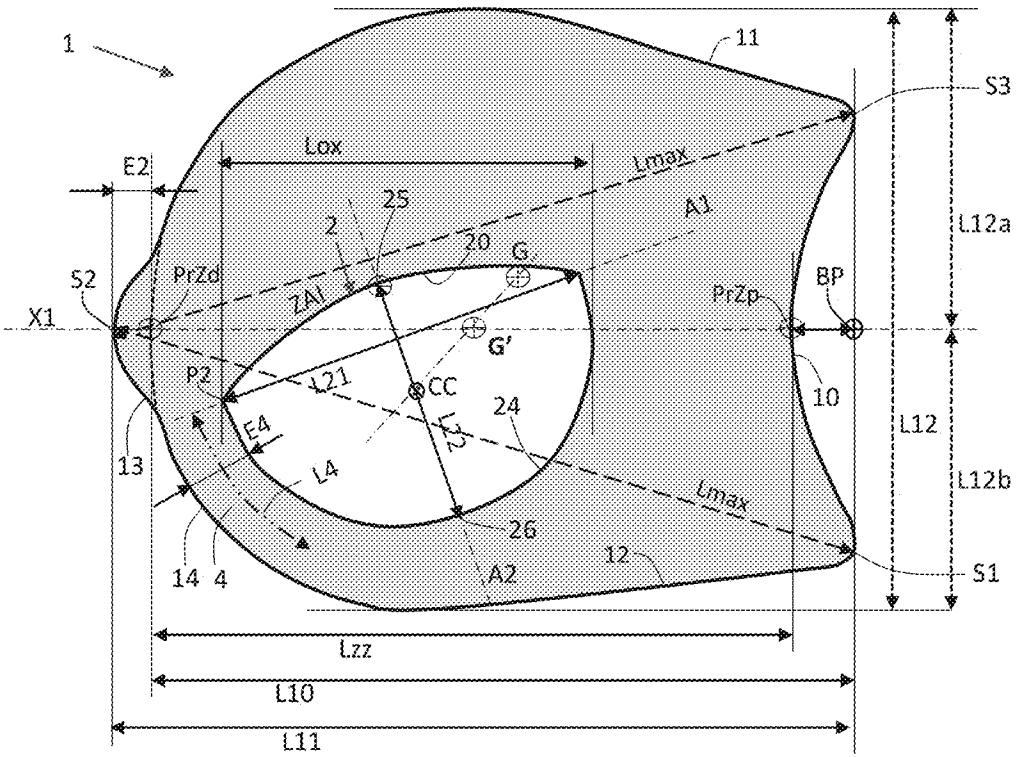
FIG. 2 illustrates, in plan view, the projectile part to be thrown of FIG. 1.
Figure 16:
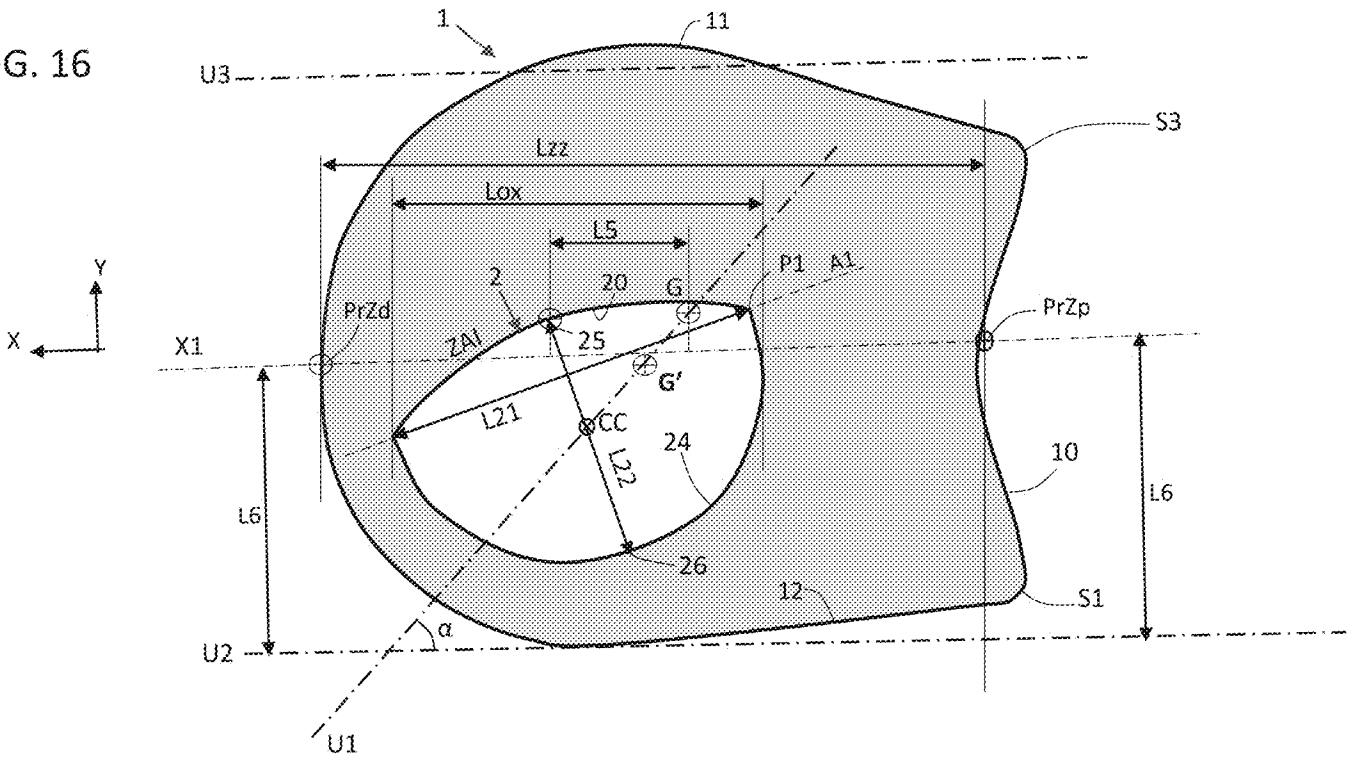
FIG. 16 illustrates, in plan view, a seventh embodiment of the projectile part to be thrown, with further a geometric construction based on the barycenters.

The through orifice may be affected from its center of gravity noted CC as visible in FIGS. 2 and 16. This barycenter CC may be calculated as a virtual center of mass. Furthermore, we have seen above that the actual projectile part has a center of mass noted G. And a projectile part without an orifice would have a center of mass noted G'. It is found that these three points are aligned.

A straight line may be drawn that passes through the points CC and G (and incidentally G'), this straight line is noted U1. From there, a second straight line offset angularly from U1 in a clockwise direction by an angle noted a is defined. This second straight line is noted U2. This second straight line U2 tangents the rear edge 12 of the projectile part. In the example illustrated, the angle $\alpha$ is 45°.

From these elements, the longitudinal axis X1 can be defined, notably in the absence of protrusion(s) and other marking shapes. For X1, a straight line parallel to the second straight line U2 and offset forward by a distance L6 may then be chosen. In practice, L6 is chosen such that L6=12.5 mm.

Although the default method has values of $\alpha$=45° and L6=12.5 mm indicated, it could optionally be for certain particular shapes, notably sharply advancing the front edge, more relevant to take close values such as 40° to 60° for a and 12 to 13 mm for L6.

The proximal reference point PrZp is then at the intersection of the longitudinal axis X1 with the proximal edge 10.

The distal reference point PrZd is then at the intersection of the longitudinal axis X1 with the distal edge 13.

Whereby, based on the barycenters CC and G, it is possible to define without ambiguity a longitudinal axis X1 and to derive therefrom the distal and proximal reference points.

Once the longitudinal axis X1 has been determined, the distance Lzz may be determined as already explained above.

Other shapes of through orifice are also considered. For example, as illustrated in FIG. 15, several alternatives of through orifice are drawn each having an overall length along the longitudinal axis marked Lo1, Lo2, Lo3 respectively.

Note that generically Lox is the overall dimension along the longitudinal axis X1.

A first dimensional ratio RD1=Lox/Lzz is defined, which first dimensional ratio RD1 is generally greater than 25%.

In some embodiments, the first dimensional ratio RD1 is between 30% and 90%.

In some embodiments, the first dimensional ratio RD1 is between 45% and 75%.

Aire1 is the total surface occupied by the part (as already explained above). Aire1 may be between 5 $cm^2$ and 10 $cm^2$, preferably between 6 $cm^2$ and 9 $cm^2$.

SF2 is the surface of the orifice. SF2 may be between 0.5 $cm^2$ and 3 $cm^2$.

A third dimensional ratio RD3=SF2/Aire1 is defined.

In some embodiments, RD3 may be between 0.1 and 0.4. In some embodiments, RD3 may be between 0.15 and 0.25.

In some embodiments, at least 60% of the surface SF2 of the through orifice 2 is located to the rear of the longitudinal axis X1.

In some embodiments, at least 70% of the surface of the through orifice 2 is located to the rear of the longitudinal axis X1.

Throwing Method

According to a general description, the user places the projectile part on his index finger and/or middle finger with the tip of the thumb inserted into the orifice 2, then by pushing his thumb forward, the user applies a tension curving thanks to the proximal bearing zone ZAP and the distal bearing zone ZAD, and beyond a predetermined tension threshold, the distal bearing zone is released and the projectile part is then projected forward with a concurrent rotational movement, the rotational movement being imparted by the retention effect on the side of the proximal bearing zone.

More generally, a digital support is used as already defined above. The throwing method may be broken down as follows:

/a/ placing the proximal support zone ZAP bearing on at least one first phalanx of the digital support, /b/ placing the distal support zone ZAD bearing on at least one other phalanx of the digital support, /c/ placing the thumb F0 in the through orifice 2 with the thumbnail bearing on the intermediate support zone ZAI.

The steps/a/,/b/,/c/may be carried out in any chronological order, i.e. different from the one above and result in the same result which is: digital support in contact with ZAP and ZAD, thumbnail in contact with ZAI.

As illustrated in FIG. 13, the bearing on the digital support may call on several pad sections belonging to several phalanxes.

It is noticeable that the thumbnail is very slanted, almost horizontal. The thumb exerts an effort marked PP.

For steps/a/and/b/, the user may use the apexes S1, S2, S3 of the protrusions as tactile and/or visual mark.

With reference to FIGS. 5, 7 and 13, it is noted that the projectile part is slightly to the rear of the index finger (or more generally the main holding finger)

Notably, the front edge 11 does not protrude or only slightly protrudes forwards from the index finger F1. Another possible mark: the rear of the index/major finger may be seen through the through orifice (2) (very visible in FIG. 7)

It may also be remarked that the rear portion (24) protrudes towards the rear of the index finger F1 or the middle finger F2 (cf. FIG. 7).

The reaction of the digital support provides a proximal reaction noted FRP and a distal reaction noted FRD. More precisely, the reaction of the proximal bearing zone FRP is directed backward and upward (very little to the distal area). Similarly, the reaction of the distal bearing zone FRD is directed backward and upward (very little to the proximal zone).

Figure 5B:
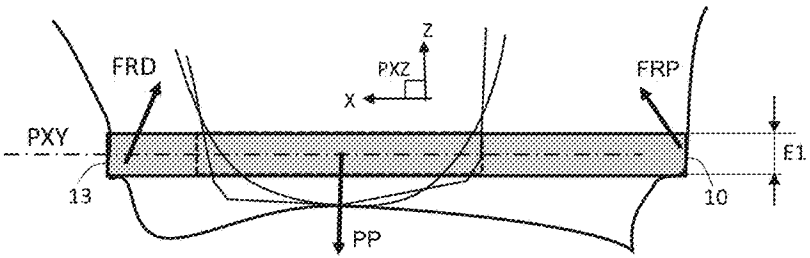
Figure 5C:
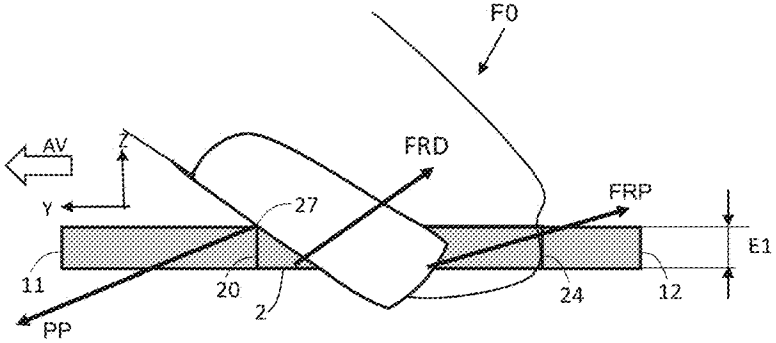

The effort PP exerted by the thumb is directed downwards (cf. FIGS. 5B and 5C).

Figure 8:
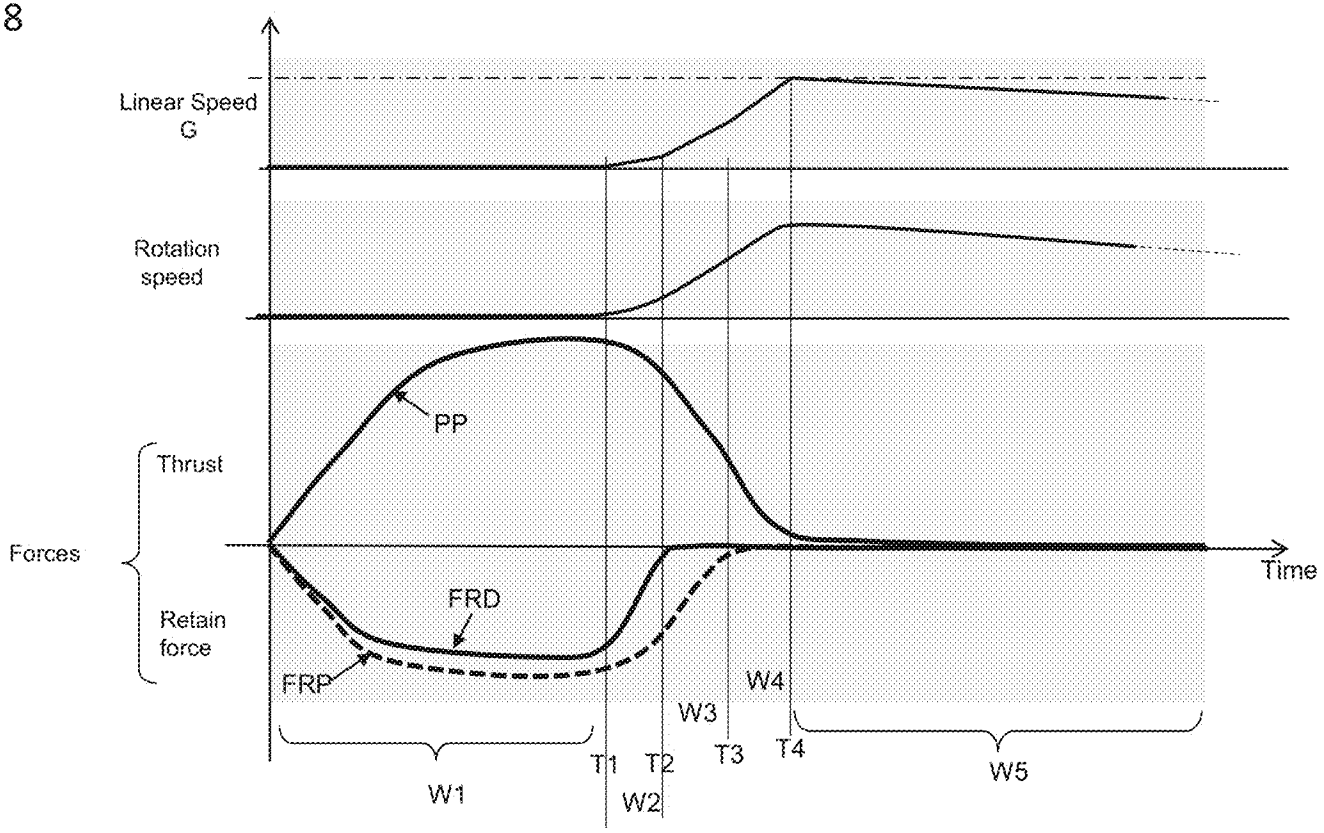
FIG. 8 illustrates a chronogram of the efforts exerted and the speeds imparted in the process of throwing the projectile to be thrown.

The curving consists in increasing the effort exerted by the thumb during the phase marked W1 in FIG. 8. The reaction of the digital support increases concurrently. The vector sum PP+FRP+FRD remains zero as long as the projectile part remains immobile before its release. This is (in tribology) a so-called static friction phase.

Figure 11:
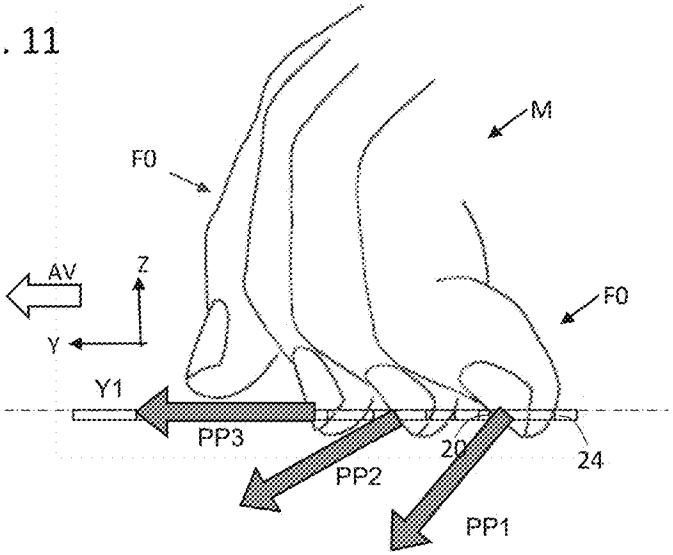
FIG. 11 schematically illustrates an evolution of the propulsion effort during throwing.

As illustrated in FIG. 11, the force PP exerted by the thumb is progressively oriented towards the horizontal PP1, PP2, PP3. This is the step marked/d/: exerting at least a forward force with the thumb while maintaining the digital support against the proximal and distal bearing zones (ZAP, ZAD) that form a bridge on the digital support.

At a given moment, an effort imbalance occurs with a thumb effort that exceeds the reaction of the bearing zones, with at least one resultant (or component) along the throwing axis Y1. A slip occurs at the level of the distal bearing zone (ZAD) to cause the release of said distal bearing zone (W2) and the forward projection of the projectile part (W3, W4, and even W2), with simultaneous rotation induced by the retention exerted by the proximal bearing zone ZAP.

When the slip occurs, it is called dynamic friction.

The preceding step is noted/e/and in other words consists in allowing a slip to occur (at least at the level of the distal bearing zone (ZAD)) to cause the release of said distal bearing zone (W2) and the forward projection of the projectile (W3, W4), with simultaneous rotation induced by the delayed release of the proximal bearing zone (ZAP).

In FIG. 8, the phase W1 represents the curving, the phase W2 (times T1 to T2) represents the distal release, the phase W3 (times T2 to T3) represents the proximal release and the phase W4 (times T3 to T4) is the end of pushing of the thumb. The phase W5 represents the free flight of the projectile part.

The linear speed and rotational speed reach their maximum at the time T4. The time-delayed release of the distal and proximal zones causes the rotation of the projectile part clockwise for a right-hander and anticlockwise for a left-hander.

Since the moment of inertia of the projectile part is low, the effort imbalance in the phase W3 imparts a significant rotation. In addition, in the phases W3 and W4, since the pushing of the thumb is offset from the center of gravity, the rotation is increased by the natural lever arm (distance G-apex 25).

As already mentioned, the center of mass G of the projectile part is located near the proximal end P1 of the intermediate bearing zone ZAI, slightly inside the through orifice, i.e. between the apex 25 and the point P1. As can be seen in FIG. 16, the top of the front portion 20 and the center of mass G are separated by a distance L5. In practice, L5 lies within a range between 4 mm and 10 mm.

This position offset allows an increase in rotation even after release of the proximal edge, (cf. phase W4, FIG. 8).

It should be remarked that the presence of the protrusions mentioned above is favorable for the implementation of the throwing method.

Figure 7B:
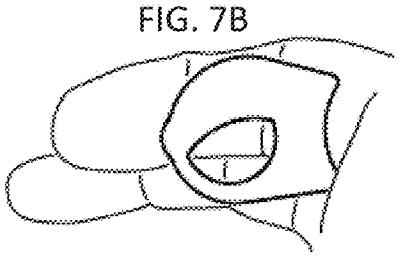
Figure 7D:
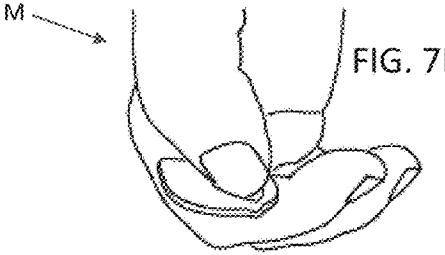
Figure 7F:
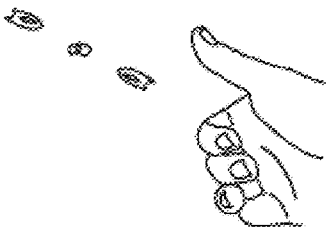
Figure 7A:
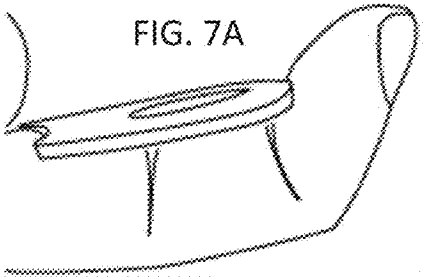
Figure 7C:
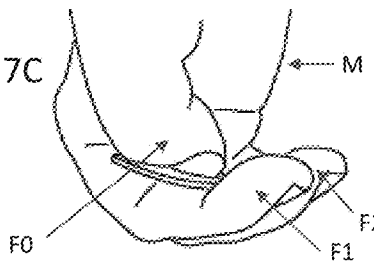

FIGS. 7A and 7B illustrate an exemplary placing of the projectile part on the digital support. FIG. 7C illustrates the situation with the thumb in place before the actual throw.

Figure 7E:
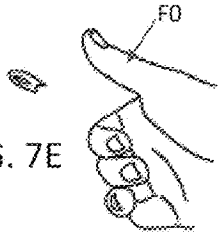

FIGS. 7D, 7E and 7F illustrate throwing phases, FIG. 7F showing several successive positions of the projectile part.

Note that the projectile part as defined geometrically above is compatible with a propulsion force applied to an edge of the through orifice by any finger of the user, i.e. not exclusively the thumb.

In some embodiments, the projectile part has only one orifice of the size described above. It is not excluded that there are other smaller holes.

In some embodiments, the projectile part has only one orifice.

The invention claimed is:

1. A projectile part, intended to be projected by means of a thumb and a digital support of a hand of a user, said projectile part presenting itself as a small plate having a thickness between 0.3 mm and 5 mm, said projectile part being delimited by an outer contour, said outer contour comprising a front edge on a side of a projection direction, a rear edge on an opposite side, a proximal edge and a distal edge, wherein a proximal bearing zone is provided intended to receive at least one phalanx of the digital support, a distal bearing zone intended to bear on at least one other phalanx of the digital support, the proximal bearing zone comprising at least one rear proximal protrusion, said projectile part comprising a through orifice arranged away from the proximal edge, said orifice having an orifice contour with a front portion forming an intermediate bearing zone and intended to receive a propulsion force formed by a bearing of a thumbnail, and a rear portion intended to receive a tip of the thumb, a longitudinal axis being defined extending between a proximal reference point of the proximal bearing zone and a distal reference point of the distal bearing zone, the projectile part having a reference length noted Lzz taken along said longitudinal axis, and the through orifice having, along the longitudinal axis, an overall dimension noted Lox, due to which a first dimensional ratio RD1=Lox/Lzz is defined, which first dimensional ratio RD1 is greater than 25%, the through orifice having an orifice width along a transversal orifice direction, called first orifice axis, the through orifice being separated from the distal edge by an escapement strip, the escapement strip having a minimum width, which is less than the orifice width, said projectile part being such that a mass of the projectile part is less than 7 grams, and the reference length noted Lzz is less than 49 mm, the proximal bearing zone being such that a section of the projectile part at this location comprises a concave part.

2. The projectile part according to claim 1, wherein a second dimensional ratio RD2=E4/L21 is defined, where E4 is the minimum width of the escapement strip and L21 is the orifice width along the first orifice axis, the second dimensional ratio RD2 being between 10% and 60%.

3. The projectile part according to claim 2, wherein the minimum width of the escapement strip is such that the second dimensional ratio RD2 is between 10% and 40%.

4. The projectile part according to claim 1, wherein the through orifice has a height along a second orifice axis perpendicular to the first orifice axis, and the height is smaller than the width.

5. The projectile part according to claim 4, wherein the height of the through orifice is smaller than 75% of the width.

6. The projectile part according to claim 1, wherein the front portion of the orifice is an arc of a circle shaped with a first radius of curvature and the rear portion of the through orifice has a second radius of curvature, and the first radius of curvature is larger than the second radius of curvature.

7. The projectile part according to claim 1, wherein the distal bearing zone comprises a distal protrusion forming a bearing on a distal or intermediate phalanx of the digital support.

8. The projectile part according to claim 1, wherein the proximal bearing zone comprises at least one front proximal protrusion.

9. The projectile part according to claim 8, wherein the proximal bearing zone is such that the section of the projectile part at this location is generally concave between the rear proximal protrusion and the front proximal protrusion.

10. The projectile part according to claim 1, having at least one of the following characteristics: having a substantially constant thickness, or wherein the projectile part is formed by cutting from a substantially flat blank, or wherein the projectile part is formed from cardboard or plastic material, with a weight per unit area between 400 g/m$^2$ and 5000 g/m$^2$.

11. The projectile part according to claim 10, wherein the projectile part is formed from cardboard or plastic material, with a weight per unit area between 700 g/m$^2$ and 1500 g/m$^2$.

12. The projectile part according to claim 1, wherein the first orifice axis is defined as an axis passing through a furthest point of a contour of the through orifice, and the first orifice axis is oriented angularly to the longitudinal axis by an angle β between 0° and 35°.

13. The projectile part according to claim 1, wherein the small plate has a substantially constant thickness.

14. The projectile part according to claim 1, wherein the reference length Lzz is less than 40 mm.

15. The projectile part according to claim 1, wherein the first dimensional ratio RD1 is between 45% and 75%.

16. The projectile part according to claim 1, wherein the projectile part is formed from at least one of the following materials: rigid paper or cardboard.

17. The projectile part according to claim 1, wherein for the outer contour of the projectile part and a surrounded surface, an isoperimetric quotient equal to Q1=[4π×Aire1/Perim2] is defined, Perim2 representing a perimeter of the outer contour and Airel representing a surface surrounded by the outer contour, and the projectile part is such that Q1 is greater than 0.6.

18. The projectile part according to claim 1, wherein a second quotient noted Q2 is defined for the outer contour of the projectile part and a surrounded surface, with Q2=ECI/Aire1, where Aire1 represents a surface surrounded by the outer contour and ECI represents a surface of a largest disk inscribed inside the outer contour, and Q2 is greater than 0.5.

19. A method for throwing a projectile part presenting as a small plate with a thickness and an outer contour, said outer contour comprising a front edge on a side of a projection direction and a rear edge on an opposite side, the projectile part comprising a proximal bearing zone intended to receive a pad of a first phalanx of a digital support of a hand of a user, a section of the projectile part at the proximal bearing zone comprising a concave part, the projectile part further comprising a distal bearing zone intended to bear on another phalanx of a digital support, the projectile part further comprising a through orifice arranged away from the proximal bearing zone, said orifice having an orifice contour with a front portion forming an intermediate bearing zone, the method comprising:

(a) placing a proximal support zone bearing on at least one first phalanx of the digital support, (b) placing a distal support zone bearing on at least one other phalanx of the digital support, (c) placing a thumb in the through orifice with a thumbnail bearing on the intermediate bearing zone, (d) exerting an effort at least forwards with the thumb while maintaining the digital support against the proximal and distal bearing zones, (e) allowing a slip to occur at a level of the distal bearing zone to cause a release of said distal bearing zone and a projection forward of the projectile part, with simultaneous rotation induced by a delayed release of the proximal bearing zone.

* * * * *